US005997134A

United States Patent [19]

Hotomi et al.

[11] Patent Number: 5,997,134

[45] **Date of Patent: *Dec. 7, 1999**

[54] INK JET HEAD AND RECORDING APPARATUS HAVING CONCAVE PORTIONS

[75] Inventors: Hideo Hotomi, Nishinomiya; Kenji Masaki, Nagaokakyo; Kusunoki Higashino, Osaka, all of Japan

[73] Assignee: Minolta Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/662,942

[22] Filed: Jun. 12, 1996

[30] Foreign Application Priority Data

Jun. 15, 1995 [JP] Japan ..... 7-148764

[51] Int. Cl.[6] ..... B41J 2/045

[52] U.S. Cl. ..... 347/70; 347/68

[58] Field of Search ..... 347/68–72, 94

[56] References Cited

U.S. PATENT DOCUMENTS

| | | | |
|---|---|---|---|
| 4,068,144 | 1/1978 | Toye | 347/68 X |
| 4,243,995 | 1/1981 | Wright et al. | 346/140 R |
| 4,377,814 | 3/1983 | Debesis | 346/140 R |
| 4,389,658 | 6/1983 | Perna et al. | 346/1.1 |
| 4,390,886 | 6/1983 | Sultan | 346/140 R |
| 4,414,553 | 11/1983 | Perna | 346/140 R |
| 4,446,469 | 5/1984 | Perna | 346/140 R |
| 4,752,788 | 6/1988 | Yasuhara et al. | 347/68 |
| 5,138,333 | 8/1992 | Bartky et al. | 347/68 X |
| 5,424,769 | 6/1995 | Sakai et al. | 347/70 |
| 5,446,485 | 8/1995 | Usui et al. | 347/72 |
| 5,471,232 | 11/1995 | Hosono et al. | 347/70 |
| 5,477,249 | 12/1995 | Hotomi | 347/71 X |
| 5,761,783 | 6/1998 | Osawa et al. | 347/70 X |
| 5,764,255 | 6/1998 | Tsurui et al. | 347/70 |

FOREIGN PATENT DOCUMENTS

| | | | |
|---|---|---|---|
| 491961A1 | 1/1992 | European Pat. Off. | B41J 2/045 |
| 62-199451 | 3/1987 | Japan . | |
| 4-126258 | 4/1992 | Japan | 347/68 |
| 558386 | 1/1993 | Japan | B41J 2/045 |
| 6-115070 | 4/1994 | Japan | 347/68 |
| 7-60960 | 7/1995 | Japan . | |
| 92/10367 | 6/1992 | WIPO | 347/71 |

OTHER PUBLICATIONS

F. Lee, R. Mill and F. Talke, "Laminated Ink Jet Head", IBM Technical Disclosure Bulletin, vol. 23, No. 7A, Dec. 1980.

*Primary Examiner*—John Barlow
*Assistant Examiner*—C. Dickens
*Attorney, Agent, or Firm*—Burns, Doane, Swecker & Mathis, LLP

[57] ABSTRACT

An inkjet recording apparatus which discharges ink onto a recording medium in response to an image signal. The above inkjet recording apparatus has an ink accommodating portion which has a plurality of ink chambers each of which accommodates ink therein and is integrally formed, thereby the ink pressurization characteristics between the ink chambers is uniform.

60 Claims, 7 Drawing Sheets

INK JET HEAD AND RECORDING APPARATUS HAVING CONCAVE PORTIONS

BACKGROUND OF THE INVENTION

1. Field of the Invention

The present invention relates to an inkjet recording apparatus that prints onto a recording medium such as copying paper by discharging ink in response to an image signal.

2. Description of the Related Art

Conventionally, an inkjet recording apparatus that prints onto a recording medium such as copying paper by discharging ink which fills up an ink chamber in response to an image signal has been proposed. In this type of recording apparatus for example, the inkjet head 90 as disclosed in U.S. Pat. No. 5,471,232 has been used as an ink discharge means.

FIG. 1 shows the above-mentioned inkjet head 90. This inkjet head 90 is comprised by spacers 94 fixed to a nozzle plate 92 where a plurality of nozzle holes 91 are formed. Said spacers 94 divide the chamber to form the ink chambers 93 which correspond to each nozzle hole 91. A vibration plate 95 is fixed to the lower portion of the spacers 94. Island portions 96 formed on the lower surface of this vibration plate 95 by means of electroforming are fixed to the top surface of a piezoelectric member 97.

In an inkjet head 90 comprising the above-mentioned construction, the piezoelectric member is made to expand and contract by applying a voltage to the piezoelectric member 97. Then, the deformation of the piezoelectric member 97 is efficiently transferred through the island portions 96 to the vibration plate 95 to either expand or contract the vibration plate. Thereby, ink inside the ink chambers 93 is pressurized by means of the vibration plate 95 after which ink droplets are discharged from the nozzle holes 91.

However, because there are a large number of members and assemblies used to form the ink chambers 93 for said inkjet head 90, irregularity in the dimensions and assembly precision of each ink chamber 93 easily occurred. As a result there are other problems such as changes in the ink pressurization characteristics due to the vibration plate and uneven diameter of the ink droplets to be discharged occurring between the ink chambers 93. Furthermore, in a type of inkjet head that pressurizes the ink chambers 93 by means of the vibration plate 95, the vibration of the piezoelectric member 97 for one ink chamber 93 is transferred to the ink housed inside the adjacent ink chambers 93 through the vibration plate 95 making the surface tension of the ink unstable. Thereby, a problem occurs in which ink leaks from the ink chamber that should not discharge ink.

SUMMARY OF THE INVENTION

The main object of the present invention is to provide an inkjet recording apparatus that can form appropriate images.

A further object of the present invention is to provide an inkjet recording apparatus with an even diameter of the ink droplets to be discharged in response to an image signal.

An even further object of the present invention is to provide an inkjet recording apparatus that does not leak ink droplets from an ink chamber that should not discharge ink.

These objects of the present invention are achieved by providing an inkjet recording apparatus having the construction described below.

An inkjet recording apparatus which discharges ink onto a recording medium in response to an image signal to form an image, said inkjet recording apparatus comprising:

an ink accommodating portion which has a plurality of ink chambers respectively accommodating ink therein, each of said ink chambers being integrally formed;

a plurality of nozzles each of which is provided at one end of each ink chamber and discharges ink therefrom;

a plurality of piezoelectric members each of which contacts with a portion of each ink chamber; and a controller which applies a voltage to said piezoelectric members in response to the image signal, the piezoelectric members being deformed by the voltage thereto to pressurize the ink in the ink chambers so that the ink in the ink chambers is discharged onto the recording medium.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
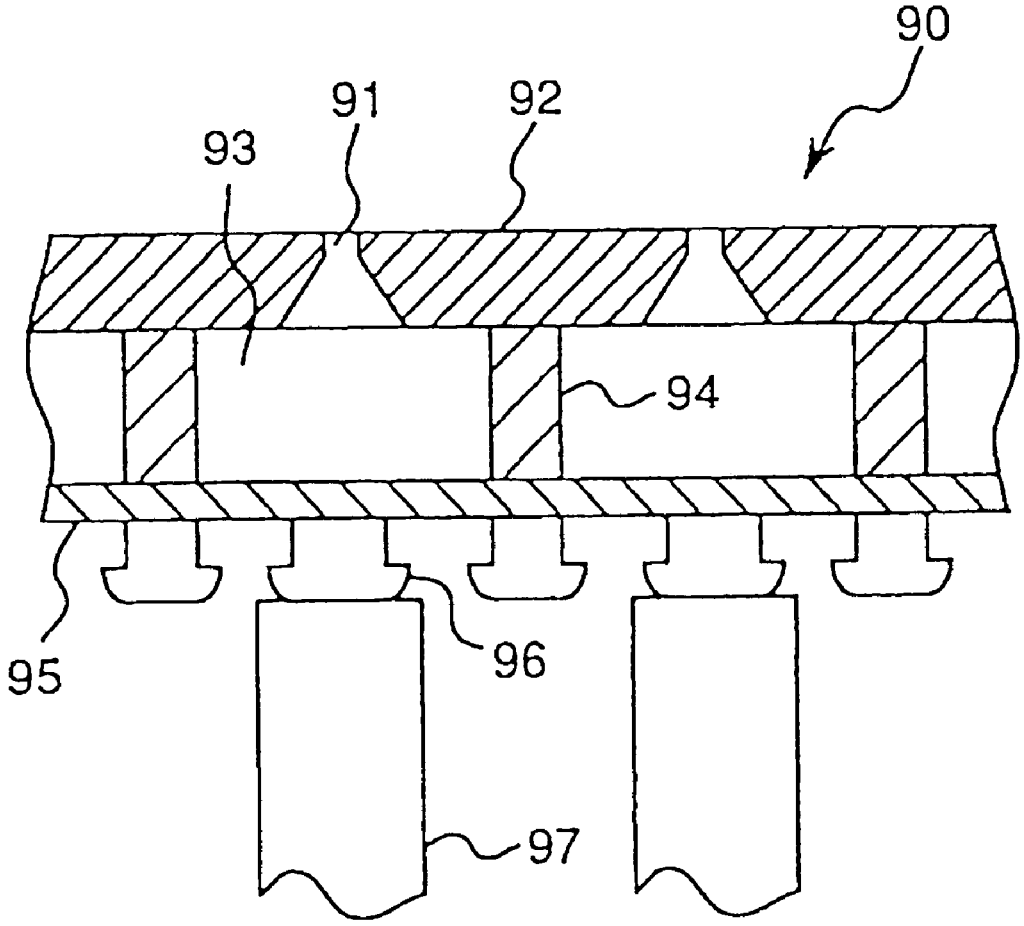
Fig. 1 Prior Art
FIG. 1 shows the construction of a conventional inkjet head.
Figure 2:
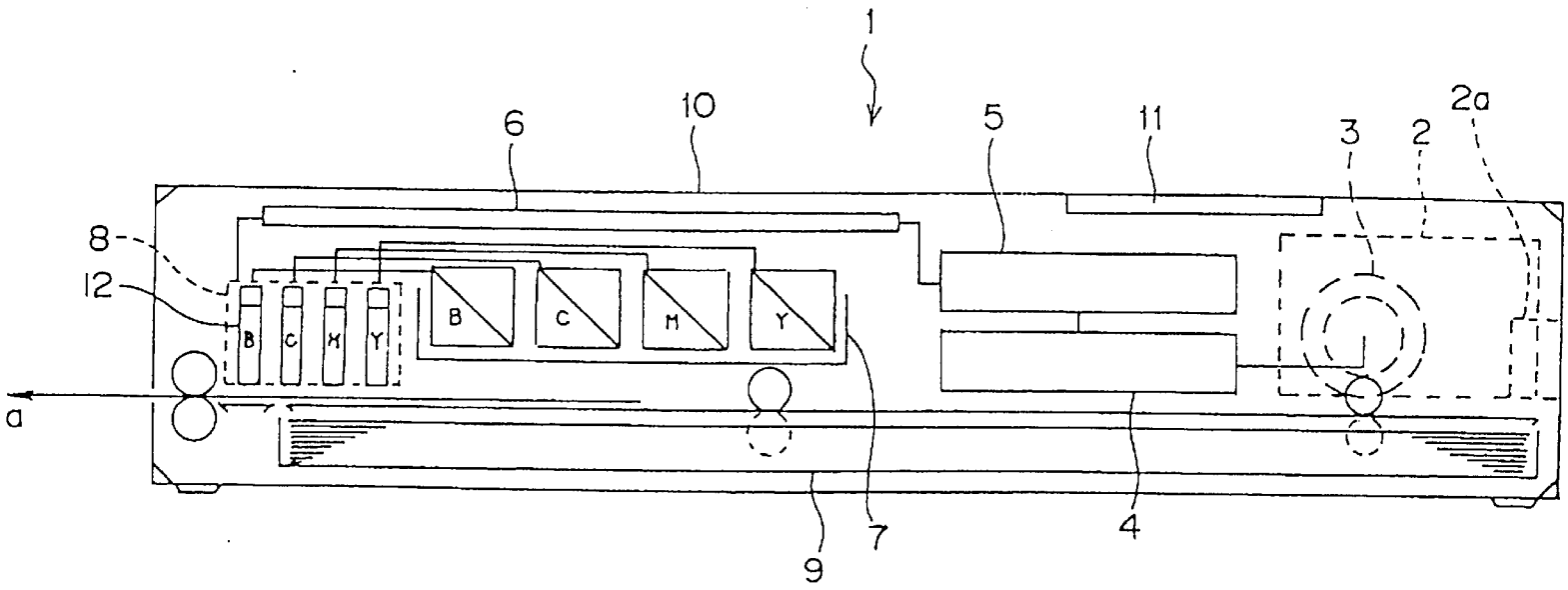
FIG. 2 is an outline of the construction of an inkjet recording apparatus according to the present invention.

The inkjet recording apparatus 1 shown in FIG. 2 is comprised by a power supply portion 2 equipped with a connector 2*a*, a drive system 3, a mechanical controller 4, a memory 5, a controller 6, an ink supply portion 7, a scan carriage 8, a feeder portion 9, a case 10, and an operation panel 11. The scan carriage 8 can scan in a direction perpendicular to a direction in which a paper passes (direction of arrow a). Within the carriage 8 along the paper passing direction are arranged four inkjet heads 12 for each color of black, cyan, magenta and yellow as well as ink discharge nozzles which face downward.

Figure 3:
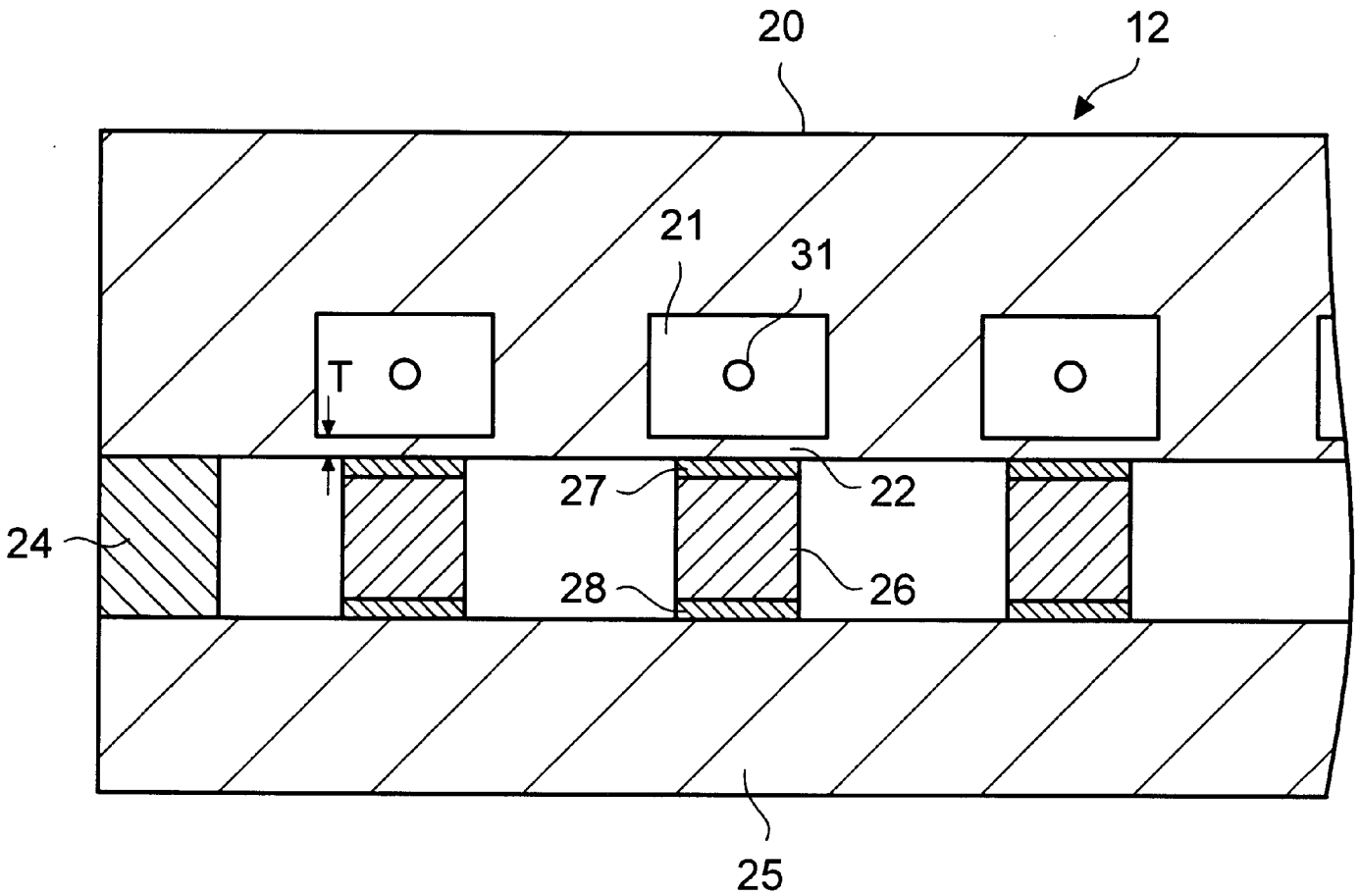
FIG. 3 is a sectional view in the crosswise direction of an inkjet head as a first embodiment of the present invention.

As shown in FIG. 3, each respective inkjet head 12 is provided with an ink chamber main body 20. The ink chamber main body 20 is a member integrally formed by means of a die cast method using a resin material with a Young's Modulus of 1500 kgf/mm$^2$ or less or more preferably, 1200 kgf/mm$^2$ or less. The inside of the ink chamber main body 20 has a plurality of hollow regions respectively forming several independent ink chambers 21. These hollow regions have a rectangular cross-section and are formed at a fixed pitch in the crosswise direction (left/right direction in FIG. 3) of the ink chamber main body 20, and additionally each of them extending in parallel along the direction perpendicular to the crosswise direction of the ink chamber main body 20. Further, the lower wall 22 of the above-mentioned hollow regions define a thickness "T" of 150 μm or less or more preferably, 100 μm or less.

For the methods to form said ink chamber main body 20, well-known methods including die casting, etching, photoresist casting and laser processing can be used independently or in combination. Moreover, the cross-section shape of said hollow regions is not restricted to a rectangular shape but can be freely selected from either a trapezoidal shape, triangular shape, circular shape or elliptical shape.

Spacers 24 (only one side shown in FIG. 3) are arranged on both sides of the lower portion of the above-mentioned ink chamber main body 20. A substrate 25 comprised by for example alumina plate is fixed to the above-mentioned ink chamber main body 20 by means of these spacers 24.

On the surface opposite to the ink chamber main body 20 of said substrate 25, a plurality of piezoelectric bodies 26 are arranged each of whose position corresponds to each hollow region. The upper portion of the piezoelectric bodies 26 are brought into contact with the outer surface of the lower wall 22 of the above-mentioned hollow regions. The upper portion of the piezoelectric bodies 26 can either be attached or not attached to the outer surface of the lower wall 22. However, if attached to the outer surface, the following action of the lower wall 22 to the vibrations of the piezoelectric bodies 26 is made more reliable thereby improving the high frequency response characteristics. While, a benefit of not being attached to the outer surface is ease of positioning when assembling the inkjet head 12.

Figure 4:
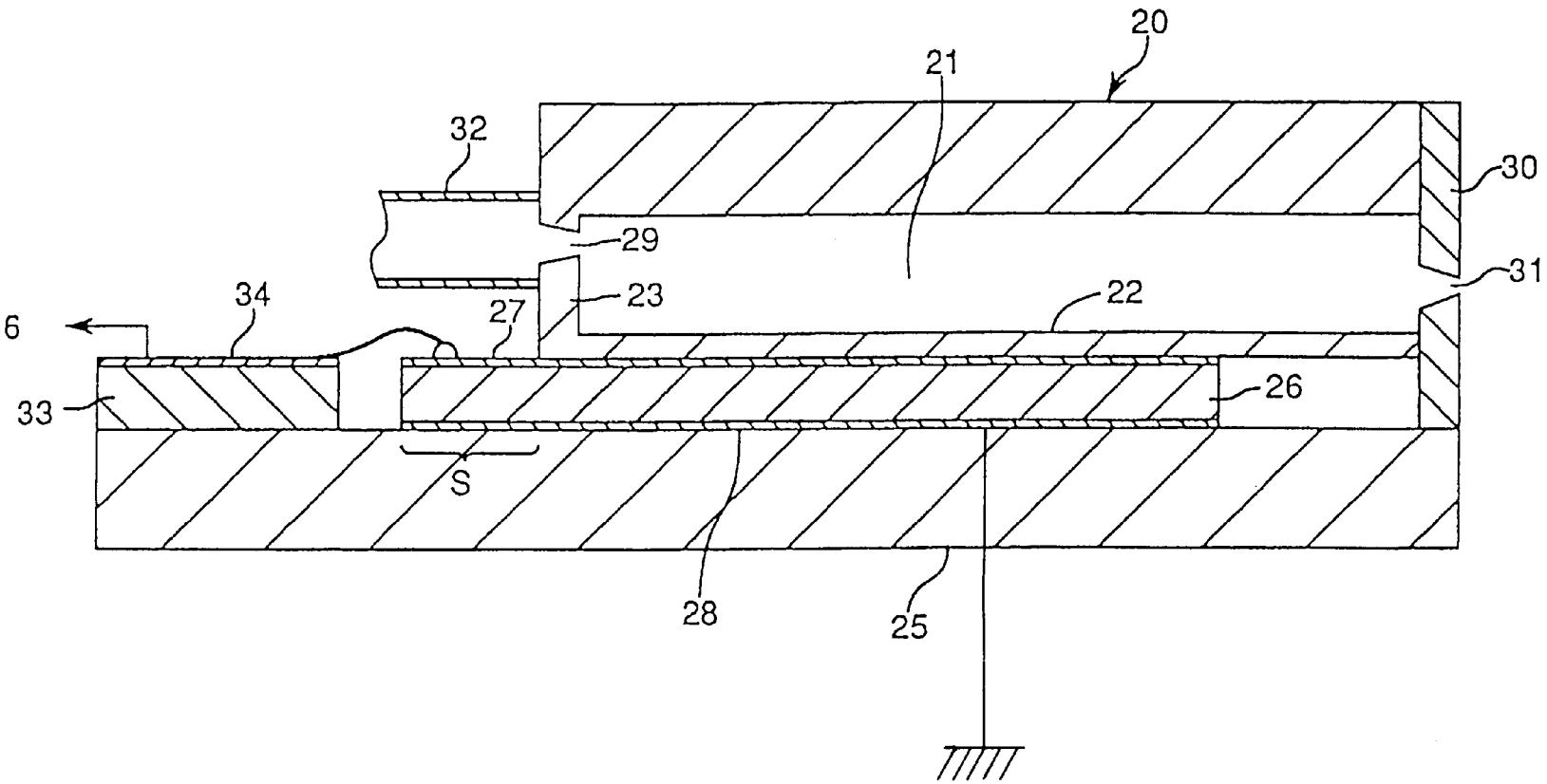
FIG. 4 is a sectional view in the lengthwise direction of an inkjet head as shown in FIG. 3.

Each of the above-mentioned piezoelectric bodies 26 has a rectangular cross-section and as shown in FIG. 4, has a long slender shaft-shaped body in the direction along the ink chamber 21. Discrete electrodes 27 are formed on the surface opposite to said lower wall 22 and common electrodes 28 are formed on the surface opposite to said substrate 25. These piezoelectric bodies 26 provide an electrode layer that functions as said electrodes 27, 28 on both sides of a plate comprised by, for example, a PZT piezoelectric ceramic by forming either a deposition Au/Ni film or a sputtering film of Au/(Ni, Cr) at an approximate thickness of 0.1 μm to 10 μm. Then, after the electrode layer is solidly attached to the above-mentioned substrate 25, it is cut and divided using, for example, a dicing saw.

Thereafter, in order to prevent lowering of the amount of distortion of the piezoelectric member 26 that occurs when a voltage is applied due to penetration of moisture in the atmosphere, it is preferable to subject the piezoelectric member to an overcoat process in which a polyimide resin, for example, is applied to the entire surface of the piezoelectric member 26 using a spin coat method, and baked for 1 hour at 180° C. However, this process can be omitted when a piezoelectric material with a high humidity resistance is used in the piezoelectric member.

As shown in FIG. 4, to ensure the above-mentioned piezoelectric member 26 freely deforms at the region opposite to the ink chamber 21, the piezoelectric member is solidly attached to the substrate 25 at rear end region S that is not opposite to the ink chamber 21. For this attachment, an adhesive agent layer that provides continuity to the common electrode 28 of each piezoelectric member 26 is formed using a conductive adhesive agent and through this adhesive agent layer each common electrode 28 is connected to ground. Conversely, the rear end of the discrete electrodes 27 of each piezoelectric member 26 is connected by means of wire bonding or similar method to a leader line 34 that is formed corresponding to each discrete electrode 27 on a support plate 33 fixed to the substrate 25. This leader line is connected to a controller 6 (see FIG. 2) which is a voltage application means via a drive IC (not shown in figure). Voltage is applied to each piezoelectric member 26 in response to image signals by means of this controller 6. Furthermore, a polarization process is carried out for each piezoelectric member 26 in a direction away from the discrete electrode 27 toward the common electrode 28.

On the front end surface of the above-mentioned ink chamber main body 20, a nozzle plate 30 is solidly attached which is comprised by, for example, polyimide film approximately 25 to 200 μm thick. On this nozzle plate 30, a plurality of nozzle holes 31 are formed corresponding to one end of each ink chamber 21 by means of, for example, an excimer laser. Their pitch is, for example, approximately 42.3 to 254 μm (pixel density: 600 to 100 dpi). Further, it is preferable for the cross-sectional area of the nozzle holes 31 to be formed in a tapered shape that becomes larger at the side opposite to the ink chamber 21 and smaller at the side facing the outer portion. This has the effect to make it difficult for air to be absorbed into the ink chamber 21 from the nozzle holes 31 during ink replenishment after ink discharge.

An ink supply opening 29 is formed on the rear wall 23 of each of the above-mentioned hollow regions and an ink tube 32 which covers this ink supply opening 29 is connected to the rear end of the ink chamber main body 20.

The ink discharge operation of the inkjet head 12 comprising the above-mentioned construction is described.

As shown in FIG. 4, the ink is supplied and fills up each ink chamber 21 from the ink supply portion 7 (see FIG. 2) via the ink tube 32 and the ink supply opening 29.

When a voltage pulse is applied to the above-mentioned piezoelectric member 26 in response to an image signal by means of the controller 6 that is the voltage application means, an electric field is formed in a direction away from the discrete electrode 27 toward the common electrode 28, or namely, parallel to the polarization direction, with the piezoelectric member 26 deforming and vibrating in the so-called thickness direction.

Figure 5:
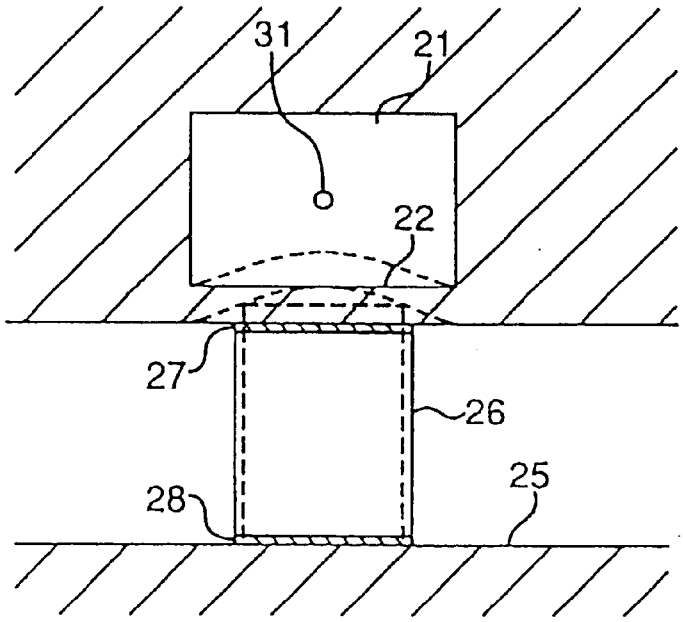
FIG. 5 shows a state when the ink chamber is pressurized by means of the piezoelectric member.

The above-mentioned piezoelectric member 26 to which is applied a voltage contracts in the crosswise direction of the inkjet head 12 as well as expands in the thickness direction. However, because this deformation is restricted at region S fixed to the substrate 25, the portion mainly corresponding to the ink chamber 21 quickly expands in the thickness direction. Then, as shown by the dotted lines in FIG. 5, the surface of the piezoelectric member at which the discrete electrode 27 is formed pushes up the lower wall 22 of the hollow regions of the ink chamber main body 20 while displacing it. The displacement of the lower wall 22 instantly reduces the capacity of the ink chamber 21 which causes the pressurized ink to discharge from the nozzle hole 31 in a fluid droplet shape which then adheres to the surface of the recording paper (not shown in figure).

Further, either a discrete electrode 27 or a common electrode 28 may be formed at the fixed region S against the substrate 25 of the piezoelectric member 26, such that no deformation occurs at this region.

If the voltage applied to the discrete electrode 27 is finished, the piezoelectric member 26 returns to its original state and simultaneously, the above-mentioned lower wall 22 also returns to its original state. At this moment, a negative pressure occurs inside the ink chamber 21 which causes ink to be supplied to the ink chamber 21 via the ink tube 32 and the ink supply opening 29 allowing preparation for the subsequent ink discharge.

However, when the voltage applied to the discrete electrode 27 is finished and then the piezoelectric member is quickly restored based on the elasticity of the piezoelectric member 26 by dropping the voltage to 0(zero) instantly, air bubbles are absorbed from the nozzle hole 31 into the ink chamber 21. This results in the possibility that the air bubbles may absorb the pressure when the subsequent voltage pulse is applied interfering with the discharge of the ink. Therefore, the nozzle hole 31 is formed in a tapered shape as stated beforehand. Further, the piezoelectric member 26 may also be restored as quickly as possible in a range in which the absorption of air bubbles does not occur by continuously lowering the value of the voltage applied to the piezoelectric member 26. It is to be noted here that the value of the voltage applied to the piezoelectric member 26 may be intermittently lowered for preventing the occurrence of air bubbles.

An image having a number of lines equal to the number of nozzles is drawn by independently carrying out the above-mentioned type of ink discharge operation for each ink chamber 21 in response to image signals and moving the scan carriage 8. By repeatedly forming this image in synchronization with the movement toward the direction the recording paper passes, the image is drawn on the recording paper in response to image signals.

In the first embodiment of the present invention as described above, a hollow region is formed inside the ink chamber main body 20 to integrally form the ink chamber 21, thereby making it possible to omit processes such as forming channels for the ink chambers or connecting a plurality of members which in turn reduces the number of processes involved in the processing and assembly allowing improvements in produceability and lower costs.

Further, the precision of each ink chamber is made uniform by integrally forming the ink chamber 21. This eliminates the ink pressurization characteristics between the ink chambers from becoming non-uniform resulting from unevenness in the assembly precision when assembling a plurality of members to form an ink chamber thereby stabilizing the diameter of the ink droplets.

Although there was the further possible problem of vibrations propagating to adjacent ink chambers through the vibration plate resulting in ink leaking from the ink chamber that should not discharge ink when one wall of each ink chamber is formed by means of the vibration plate as a separate member for pressurizing the ink in the conventional ink head, that type of problem is also eliminated in the first embodiment in which each the ink chamber is integrally formed thereby achieving a stable ink discharge.

Figure 6:
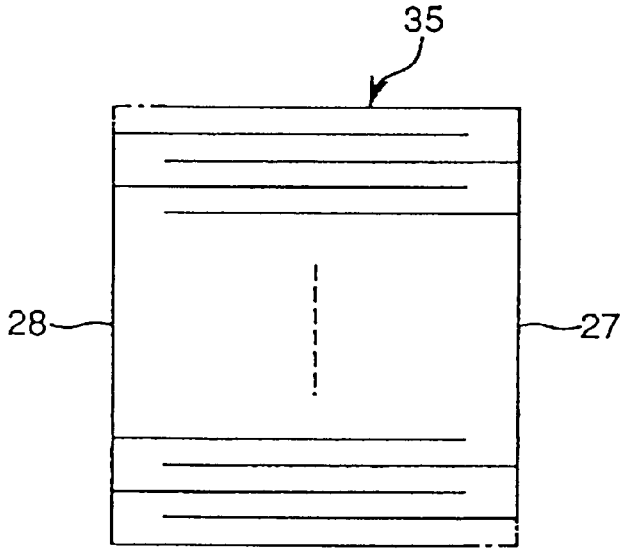
FIG. 6 is a side view of a layered type piezoelectric member.

Thereupon, in the first embodiment as described above, although single layer piezoelectric bodies 26 are used, as shown in FIG. 6, if a layered type piezoelectric member 35 is used in which an n number of layers consisting of at least two or more layers of multi-layer piezoelectric material are laminated by means of the well-known green sheet method and the discrete electrode 27 and the common electrode 28 both functioning as an attachment layer are internally arranged is used, it is possible to obtain a large effective displacement in proportion to the number of layers, thereby making it possible to obtain an almost equal displacement quantity at a low voltage compared to a single layer device. This has the effect of allowing the drive voltage of the device to be lowered and reducing the load of the driver IC thereby allowing lower cost low-voltage ICs to be used and lowering the cost of the drivers. Moreover, the broken line portion of the outer edge of the layered type piezoelectric member 35 in FIG. 6 indicates where an electrode is not formed to prevent short-circuits.

Figure 7:
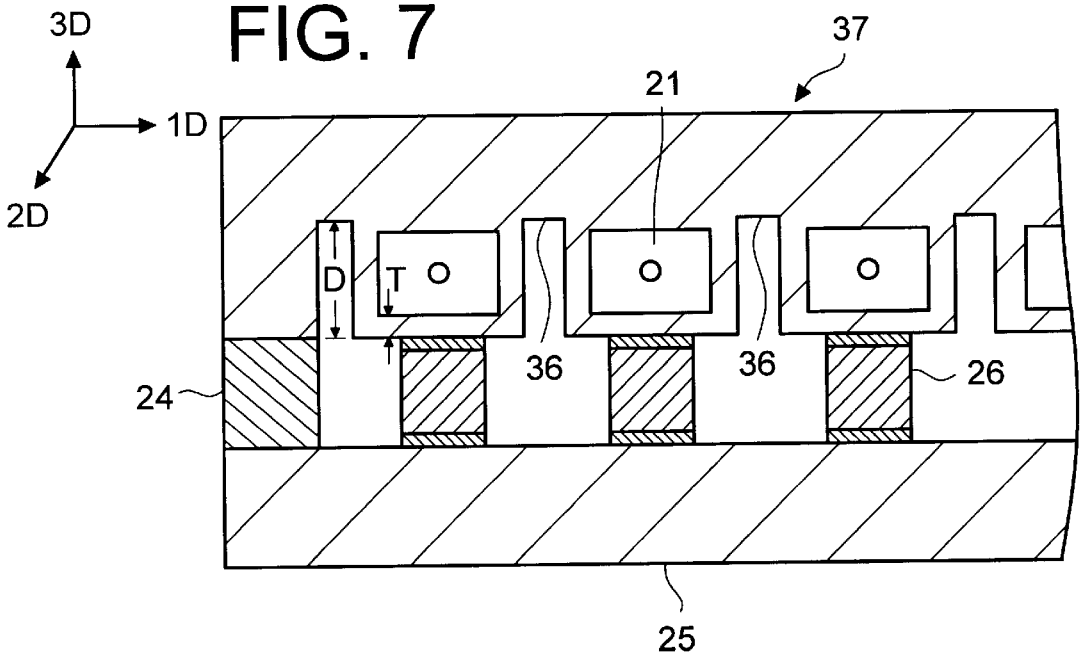
FIG. 7 is a sectional view in the crosswise direction of an inkjet head as a second embodiment of the present invention.

As shown in a second embodiment shown in FIG. 7, in place of the above-mentioned ink chamber main body 20, if an ink accomodating portion or ink chamber main body 37 is used in which a plurality of channel-shaped concave portions 36 are formed on the surface opposite to the substrate 25 and the hollow regions forming ink chambers 21 by these channel-shaped concave portions 36 is surrounded in those three directions by a thin wall which forms a convex portion having thickness T, it is possible to more reliably prevent the occurrence of crosstalk caused by the vibrations interacting with each other between the adjacent ink chambers 21 and resulting in the ink leaking from the ink chamber that should not discharge ink. The convex portions are separated from the concave portions 36 by a depth "D". The ink chambers 21 are aligned in a first directional 1D. Each ink chamber extends in a second direction which is orthogonal to the first direction 1D. A third direction 3D is defined which is orthogonal to the first and second directions (1D, 2D).

Figure 8:
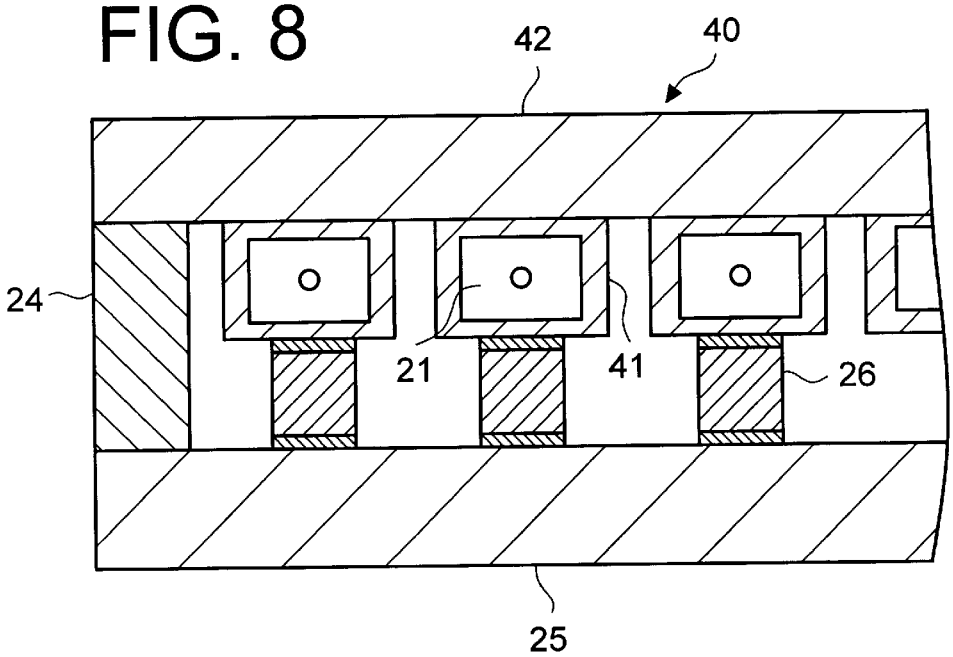
FIG. 8 is a sectional view in the crosswise direction of an inkjet head as a third embodiment of the present invention.

The ink chamber main body 40 of the inkjet head in a third embodiment shown in FIG. 8 is not an integrated member but comprises a plurality of hollow members 41 each of which defines a convex portion and an ink accommodating portion, with one integrally formed ink chamber 21 surrounded by thin walls formed inside each hollow member and a fixing plate 42 that solidly attaches the hollow members 41 at a fixed pitch. This also allows effects to be obtained identical to when the above-mentioned ink chamber main body 37 is used.

Figure 9:
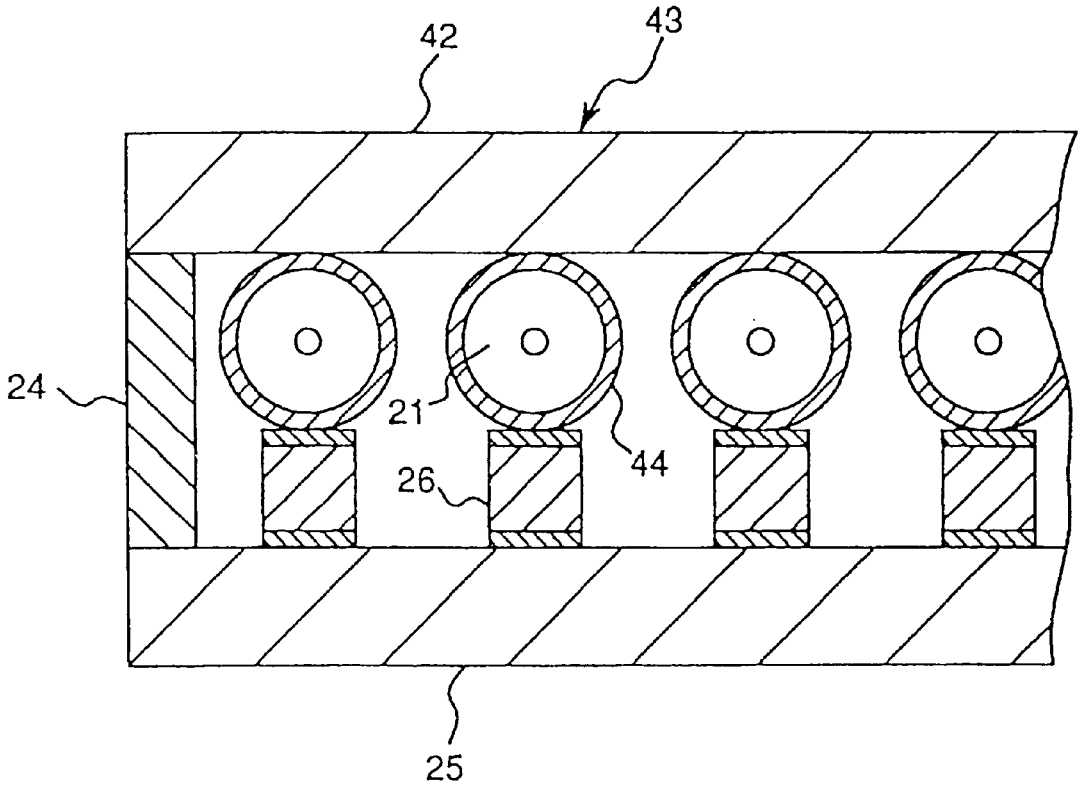
FIG. 9 is a sectional view in the crosswise direction of an inkjet head as a fourth embodiment of the present invention.

The ink chamber main body 43 of the inkjet head as a fourth embodiment shown in FIG. 9 is also comprised by a plurality of hollow members 44 each of which defines a convex portion and an ink accommodating portion, and a fixing plate 42. However, in contrast to the rectangular tube shape of the above-mentioned hollow members 41, the above-mentioned hollow members 44 are formed in a cylindrical shape. From this shape, the hollow members 44 have an excellent restorability after deformation which improves the response characteristics toward vibrations of the piezoelectric bodies 26 allowing faster printing speeds. Further, because the attachment region between the hollow members 44 and the fixing plate 42 is small, the possibility that vibrations may be propagated through the fixing plate 42 is lessened making it possible to suppress ink leaks from ink chambers adjacent to ink chambers which discharge ink.

The above-mentioned hollow members 41, 44 of the fourth embodiment are formed using a resin material similar to the ink chamber main body 20 of the above-mentioned first embodiment and the fixing plate 42 is formed using a rigid body.

Next, resin materials which can be used for the ink chamber main bodies 20, 37 and the hollow members 41, 44 will be described.

(1) Heat cured resin including epoxy resin, phenoxy resin, urethane resin, nylon type, silicon resin, fluorosilicon resin, phenol resin, melamine resin, xylene resin, alkyd resin or heat cured acrylic resin.

From among the above-mentioned materials, epoxy resin, phenoxy resin and fluorosilicon resin can be preferably used.

(2) Thermoplastic resin including polyester resin, polyamide resin, polysulfone resin, acrylic resin, aramid resin, ethylene vinyl acetate resin, ionic cross-linked olefin copolymer (ionomer), styrene butadiene block copolymer, polyacetal, polyphenylene sulfide, polycarbonate, vinyl chloride vinyl acetate copolymer, cellulose ester, polyimide or styrene resin.

From among the above-mentioned materials, aramid resin, polyimide resin, polyamide resin, polysulfone resin and ethylene vinyl acetate resin can be preferably used.

(3) Liquid crystal polymer (4) Photosensitive resin, thick film photoresist resin (5) Rubber, synthetic rubber Further, the materials in (1) to (5) presented above can be used independently or in combination, and other powder materials, whiskers or glass fillers can be added as well.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An inkjet recording apparatus which discharges ink onto a recording medium in response to an image signal to form an image, said inkjet recording apparatus comprising:

a member made of a single material;

a plurality of adjacent ink chambers aligned in a predetermined direction for accommodating ink therein, said ink chambers being defined only by said member and a nozzle plate, said member having a plurality of concave portions formed on a surface of said member, each of said concave portions being located between neighboring ones of said adjacent ink chambers with respect to said predetermined direction;

a plurality of nozzles each of which is respectively provided at one end of each ink chamber and discharges the ink therefrom;

a plurality of pressurizing members, each of said pressurizing members directly pressurizing a portion of said member external to a respective one of the ink chambers; and a controller which selectively applies a voltage to said pressurizing members in response to the image signal, the pressurizing members being deformed by the voltage thereto to pressurize the ink in the ink chambers so that the ink in the ink chambers is discharged.

2. The inkjet recording apparatus as claimed in claim 1 wherein said member is formed of a resin material.

3. The inkjet recording apparatus as claimed in claim 1 wherein said member has a plurality of walls corresponding to the ink chambers, respectively, each of said walls defined by a respective one of the ink chambers and a surface of the member, at least a portion of each wall has a thickness of 150 μm or less at least at the portion defined by the respective ink chamber.

4. The inkjet recording apparatus as claimed in claim 1 wherein the voltage applied to said pressurizing members by said controller has a pulse form.

5. The inkjet recording apparatus as claimed in claim 1 wherein the controller gradually lowers the value of the voltage applied to the pressurizing members upon stopping the application of the voltage to pressurizing members.

6. The inkjet recording apparatus as claimed in claim 1, wherein said adjacent ink chambers are separated from each other by a respective one of the concave portions.

7. The inkjet recording apparatus as claimed in claim 1, wherein said plurality of pressurizing members are distinct and separate from said member and apply pressure to the surface of said member having the plurality of concave portions.

8. The inkjet recording apparatus as claimed in claim 1, wherein said inkjet recording apparatus further comprises at least one substrate fixed to said member.

9. The inkjet recording apparatus as claimed in claim 1, wherein said member is made only of said single material.

10. An inkjet head for discharging ink onto a recording medium in response to an image signal, said inkjet head comprising:

a member made of a single material;

a plurality of adjacent ink chambers aligned in a predetermined direction for accommodating ink therein, said ink chambers being defined only by said member and a nozzle plate, said member having a plurality of concave portions formed on a surface of said member, each of said concave portions being located between neighboring ones of said adjacent ink chambers with respect to said predetermined direction;

a plurality of nozzles each of which is respectively provided at one end of a respective one of the ink chambers and discharges the ink therefrom; and a plurality of pressurizing members, each of said pressurizing members directly pressurizing a portion of said member external to a respective one of the ink chambers.

11. The inkjet recording apparatus as claimed in claim 10 wherein said member is formed of a resin material.

12. The inkjet head as claimed in claim 10 wherein said member has a plurality of walls corresponding to the ink chambers, respectively, each of said walls defined by a respective one of the ink chambers and a surface of the member, at least a portion of each wall has a thickness of 150 μm or less at least at the portion defined by the respective ink chamber.

13. The inkjet head as claimed in claim 10 wherein each of the nozzles has a tapered shape.

14. The inkjet head as claimed in claim 10 wherein each of said pressurizing members is formed of a piezoelectric member.

15. The inkjet head as claimed in claim 14, wherein the piezoelectric member contacts a respective wall portion of the member through a discrete electrode formed on an upper surface of the piezoelectric member, and the piezoelectric member is attached to a substrate through a common electrode formed on a lower surface of the piezoelectric member.

16. The inkjet head as claimed in claim 10 wherein each of the ink chambers has a rectangular tube shape.

17. The inkjet head as claimed in claim 10 wherein each of the ink chambers has a cylindrical shape.

18. The inkjet recording apparatus as claimed in claim 10, wherein said adjacent ink chambers are separated from each other by a respective one of the concave portions.

19. The inkjet head of claim 10, wherein said plurality of pressurizing members are distinct and separate from said member and apply pressure to the surface of said member having the plurality of concave portions.

20. The inkjet recording head as claimed in claim 10, wherein said inkjet recording head further comprises at least one substrate fixed to said member.

21. The inkjet head as claimed in claim 10, wherein said member is made only of said material.

22. A member in combination with a plurality of pressurizing members provided in an inkjet head which discharges ink in response to an image signal, said member comprising a single material having a plurality of adjacent ink chambers aligned in a predetermined direction and defined only by said member and a nozzle plate, and said member further comprising a plurality of concave portions formed on a surface of said member, each of said concave portions being located between neighboring ones of said ink chambers with respect to said predetermined direction, and each of said plurality of pressurizing members directly pressurizing a portion of said member external to a respective one of the ink chambers.

23. The combination as claimed in claim 22, wherein said member is formed of a resin material.

24. The inkjet recording apparatus as claimed in claim 22, wherein said adjacent ink chambers are separated from each other by a respective one of the concave portions.

25. The combination claimed in claim 22, wherein said plurality of pressurizing members are distinct and separate from said member and apply pressure to the surface of said member having the plurality of concave portions.

26. The combination as claimed in claim 22, the combination further comprising at least one substrate fixed to said member.

27. The combination as claimed in claimed in claim 22, wherein said member is made only of said single material.

28. An inkjet head for discharging ink onto a recording medium in response to an image signal, said inkjet head comprising:

an ink accommodating portion having a singular member made only of a single material, said singular member having a first surface with a plurality of concave portions and with a plurality of convex portions, said concave portions and said convex portions being alternatively aligned in a predetermined direction, and said ink accommodating portion further having a second surface made of the material, said ink accommodating portion further having a plurality of adjacent ink chambers corresponding to said convex portions with respect to the predetermined direction, respectively, each of said adjacent ink chambers being located between the respective one of said convex portions and said second surface; and a plurality of piezoelectric members corresponding to said convex portions, respectively, each of said piezoelectric members being located outside said ink chambers and in contact with the respective one of said convex portions.

29. The inkjet head as claimed in claim 28 wherein said singular member has a thickness between each of said convex portions and the respective one of said ink chambers, said thickness being 150 $\mu$m or less.

30. The inkjet head as claimed in claim 28 wherein said singular member has a thickness between each of said convex portions and the respective one of said ink chambers;

each of said convex portions being separated from each of said concave portions by a depth; and said thickness being smaller than said depth.

31. The inkjet head as claimed in claim 28 wherein said second surface is opposite to said first surface.

32. The inkjet head as claimed in claim 28 wherein said adjacent ink chambers are separated from each other by a respective one of the concave portions.

33. The inkjet head as claimed in claim 28, wherein said plurality of piezoelectric members are distinct and separate from said ink accommodating portion.

34. The inkjet head as claimed in claim 28, wherein said inkjet head further comprises at least one substrate, said piezoelectric members arranged in contact with the substrate and between the substrate and the respective convex portions.

35. An inkjet head for discharging ink onto a recording medium in response to an image signal, said inkjet head comprising:

a plurality of adjacent ink chambers formed in a predetermined direction, and a singular member made only of a single material, said singular member having a first surface with a plurality of concave portions aligned in said predetermined direction and with a plurality of regions between said concave portions, respectively, said inkjet head further having a second surface made of the single material, said second surface being opposed to said first surface, said first surface being common to all of said ink chambers, said ink chambers being located between said first surface and said second surface, said ink chambers corresponding to said regions of said first surface defined between said concave portions, respectively; and a plurality of piezoelectric members located on said regions of said first surface defined between said concave portions, respectively, said piezoelectric members being located outside said ink chambers.

36. The inkjet head as claimed in claim 35, wherein said second surface is located on said singular member.

37. The inkjet head as claimed in claim 35, wherein each of said piezoelectric members has a first electrode and a second electrode.

38. The inkjet head as claimed in claim 37, wherein said piezoelectric members have first surfaces, and second surfaces which are opposed to said first surfaces, respectively, said first electrodes and said second electrodes are formed on said first surfaces of said piezoelectric member and said second surfaces of said piezoelectric members, respectively, and said first electrodes are in contact with said regions defined between said concave portions, respectively.

39. The inkjet head as claimed in claim 35, wherein said plurality of piezoelectric members are distinct and separate from said ink accommodating portion.

40. The inkjet head as claimed in claim 35, wherein said inkjet head further comprises at least one substrate, said piezoelectric members arranged in contact with the substrate and between the substrate and the respective convex portions.

41. An inkjet head for discharging ink onto a recording medium in response to an image signal, said inkjet head comprising:

a plurality of adjacent ink chambers formed in a predetermined direction, and a singular member made only of a single material, said singular member having a first surface with a plurality of concave portions each of which is located between adjacent ink chambers with respect to said predetermined direction, respectively, said inkjet head further having a second surface made of the single material, said second surface being opposed to said first surface, said first surface being common to all of said ink chambers, said ink chambers being located between said first surface and said second surface;

a plurality of piezoelectric members located outside said ink chambers and on said first surface, said piezoelectric members corresponding to said ink chambers, respectively.

42. The inkjet head as claimed in claim 41, wherein said second surface is located on said singular member.

43. The inkjet head as claimed in claim 41, wherein each of said piezoelectric members has a first electrode and a second electrode.

44. The inkjet head as claimed in claim 43, wherein said piezoelectric members have first surfaces, and second surfaces which are opposed to said first surfaces, respectively, said first electrodes and said second electrodes are formed on said first surfaces of said piezoelectric member and said second surfaces of said piezoelectric members, respectively, and said first electrodes are in contact with said first surface of said singular member.

45. The inkjet head as claimed in claim 41, wherein said plurality of piezoelectric members are distinct and separate from said ink accommodating portion.

46. The inkjet head as claimed in claim 41, wherein said inkjet head further comprises at least one substrate, said piezoelectric members arranged in contact with the substrate and between the substrate and the respective convex portions.

47. An inkjet head for discharging ink onto a recording medium in response to an image signal, said inkjet head comprising:

a plurality of adjacent ink chambers formed in a predetermined direction, and a singular member made only of a single material, said singular member having a first surface, said inkjet head further having a second surface made of the single material, said singular member being common to all of said ink chambers, said first surface defining a plurality of grooves in said predetermined direction and a plurality of regions between said grooves, respectively, said ink chambers being located between said first surface and said second surface, said ink chambers corresponding to said regions of said first surface defined between said grooves, respectively, and each of said grooves being located between said adjacent ink chambers;

a plurality of pressurizing members located on said regions of said first surface defined between said grooves, respectively, said pressurizing members being located outside said ink chambers.

48. The inkjet head as claimed in claim 47, wherein said grooves are substantially concave, and said regions between said grooves are substantially convex.

49. The inkjet head as claimed in claim 47, wherein said inkjet head further comprises at least one substrate, said pressurizing members arranged in contact with the substrate and between the substrate and the respective convex portions.

50. The inkjet head as claimed in claim 47, wherein said inkjet head further comprises at least one substrate, said pressurizing members having a surface opposite from that located on said first surface, and said substrate contacting said surface.

51. An inkjet head for ejecting ink onto a recording medium, said inkjet head comprising:

an ink accommodating unit made only of a single material, said ink accommodating unit internally having a plurality of spaces aligned in a first direction, each of said spaces being for accommodating ink and extending in a second direction orthogonal to said first direction, each of said spaces having a cross section taken in a plane parallel to said first direction and orthogonal to said second direction, wherein along a portion of each space intersected by the cross section, each space is defined by a plurality of contiguous interior surfaces of said ink accommodating unit, said interior surfaces being made of said single material, said ink accommodating unit having an exterior surface with a plurality of concave portions and with a plurality of convex portions, said concave portions and said convex portions being alternatively aligned in said first direction, said convex portions being respectively corresponding to said spaces with respect to the first direction; and a plurality of pressuring members respectively provided on the convex portions of said external surface.

52. The inkjet head as claimed in claim 51, wherein each of said pressuring members is made of a piezoelectric material.

53. The inkjet head as claimed in claim 51, wherein said ink accommodating unit is a singular member made of said single material.

54. The inkjet head as claimed in claim 51, wherein said concave portions are a plurality of grooves aligned in said first direction, each of said grooves being extending in said second direction.

55. The inkjet head as claimed in claim 54, wherein said interior surfaces of each space includes a specific interior surface which is spaced farthest away from a respective one of the convex portions in a third direction, said specific interior surface being parallel to said first direction, and the third direction is orthogonal to said second direction, a distance between the exterior surface at each convex portion and the exterior surface at each concave portion in said third direction is larger than a distance between the exterior surface at each convex portion and each specific interior surface in said third direction.

56. The inkjet head as claimed in claim 51, wherein the cross section of each space has a first width in said first direction, and each pressuring member has a second width in said first direction, said first width being larger than said second width.

57. An inkjet head for ejecting ink onto a recording medium, said inkjet head comprising:

an ink accommodating portion, said ink accommodating portion comprises a plurality of hollow members each of which are made of a single material, each of said hollow members having at least one interior surface and at least one exterior surface, said at least one exterior surface of each of said hollow members defining a convex portion;

a fixing plate;

each of said hollow members being attached to said fixing plate;

each of said hollow members defining an ink chamber, said ink chamber defined by said at least one interior surface; and a plurality of pressurizing members, each of which is provided along the exterior surface of a respective one of said hollow members.

58. The inkjet head as claimed in claim 57, wherein said at least one interior surface is an arcuate surface.

59. The inkjet head as claimed in claim 58, wherein said arcuate surface is a generally cylindrical surface.

60. The inkjet head as claimed in claim 57, wherein said inkjet recording head further comprises at least one substrate fixed to said fixing member.

* * * * *